United States Patent [19]

Lipp et al.

[11] Patent Number: 4,517,900

[45] Date of Patent: May 21, 1985

[54] TESTING AND/OR PRACTICE PROJECTILE FOR AN ARTILLERY WEAPON

[75] Inventors: Herbert Lipp, Düsseldorf; Horst Reckeweg, Heiligenhaus, both of Fed. Rep. of Germany

[73] Assignee: Rheinmetall GmbH, Duesseldorf, Fed. Rep. of Germany

[21] Appl. No.: 512,778

[22] Filed: Jul. 11, 1983

[30] Foreign Application Priority Data

Jul. 10, 1982 [DE] Fed. Rep. of Germany ..... 3225984

[51] Int. Cl.[3] ..... F42B 9/20

[52] U.S. Cl. ..... 102/529; 102/524

[58] Field of Search ..... 102/444, 524–529

[56] References Cited

U.S. PATENT DOCUMENTS

| | | | |
|---|---|---|---|
| 34,493 | 2/1862 | Havens | 102/525 |
| 112,121 | 2/1871 | Butler | 102/525 |
| 628,106 | 7/1899 | Maxim et al. | 102/526 |
| 784,087 | 3/1905 | Wang | 102/529 |

*Primary Examiner*—Harold J. Tudor

[57] ABSTRACT

A testing and/or practice projectile assembly for preselected use in an artillery weapon in lieu of conventional live ammunition. The projectile assembly includes a casing which has an axial length which is less by a predetermined distance than that of the conventional live projectile. An insert member is operatively mounted in said casing. The length and diameter of the insert member is such that the exterior contour and total length of the projectile assembly (insert member and casing) corresponds to that of a conventional live projectile when the insert member is operatively mounted on the casing. The insert member has an annular recess and guide band segments are mounted in the recess. The guide band segments are pressed outwardly to conform to a predetermined exterior guide band diameter and can be selectively retractably released. A pull rod is coaxially connected to the insert member and band segments via a biasing cone so as to selectively release the band segments.

5 Claims, 2 Drawing Figures

TESTING AND/OR PRACTICE PROJECTILE FOR AN ARTILLERY WEAPON

BACKGROUND OF THE INVENTION

The invention relates to a testing and/or practice projectile for an artillery weapon. Such projectiles have as one of their objects to test the functioning of the projectile loading mechanism for the weapon and as another object to permit the personnel servicing the artillery weapon to be trained by means of practice projectiles, so as to effect a smooth flowing ammunition loading and firing without the utilization of life ammunition.

With the known practice ammunition, the projectile which is placed in the breech of the weapon is frequently so firmly lodged within the gun barrel that it occasionally requires special tools which are difficult to be applied. For example, an expelling rod with a hydraulic cylinder or spindle is required which serves to push out the practice ammunition, whereby a large force, for example 300 KN is required to be applied. In extreme cases it is even necessary to fire the projectile in order to remove it from the gun barrel, which of course makes it non-reusable. Moreover, the useful life of such practice projectiles is reduced in view of the fact that the guide band of the projectile is pressed into the gun barrel bore surface, in particular when the inner surface of the gun barrel is rifled.

SUMMARY OF THE INVENTION

It is an object of this invention to provide a projectile which can be easily pulled out of a gun barrel, can be used several times, with which any possible gun barrel elevation as well as any functioning test of the loading arrangement is possible; and with which also the entire feeding operation for the loading and firing process can be carried out with the practice projectile, not only manually, but also when their is present an automatic projectile loading arrangement.

BRIEF DESCRIPTION OF THE DRAWING

With these and other objects in view, which will become more apparent in the following detailed description, the present invention is shown by way of example only and will be clearly understood in conjunction with the accompanying drawing, in which.

DETAILED DESCRIPTION

Figure 1:
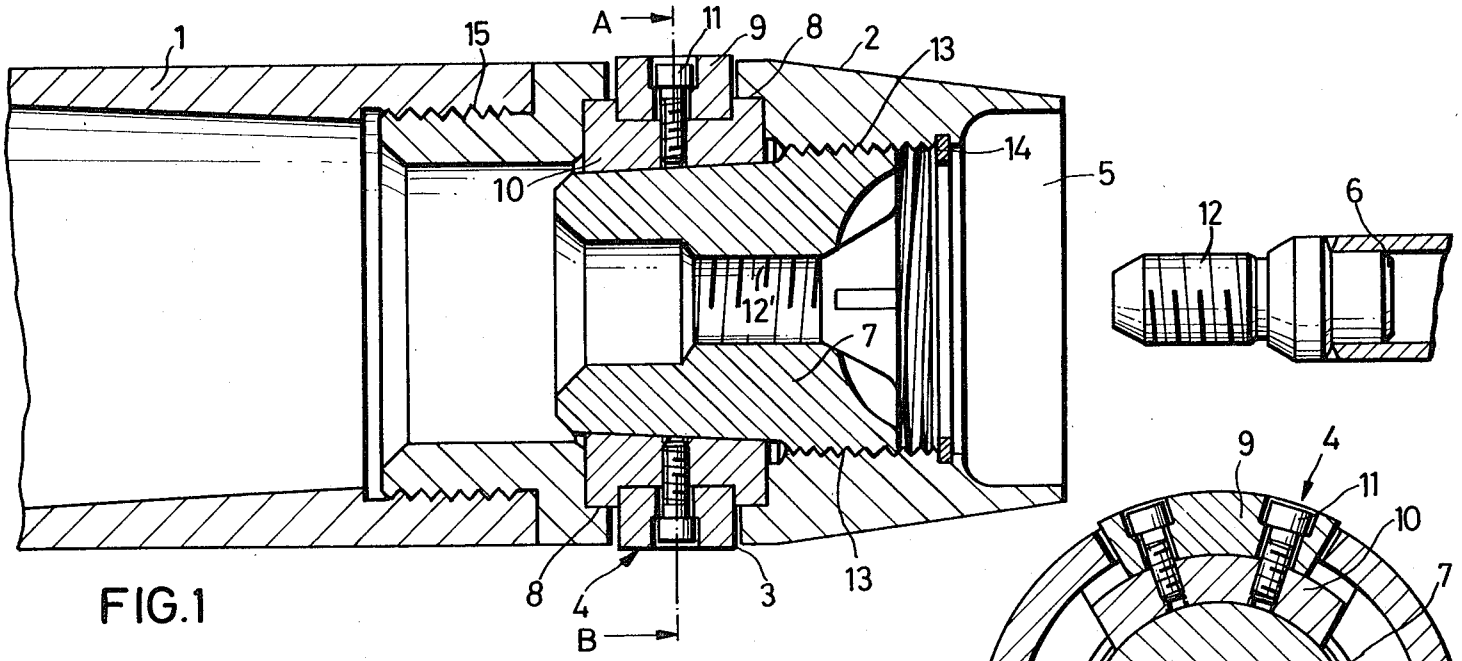
FIG. 1 is a longitudinal sectional view of the projectile with a portion cut away.
Figure 2:
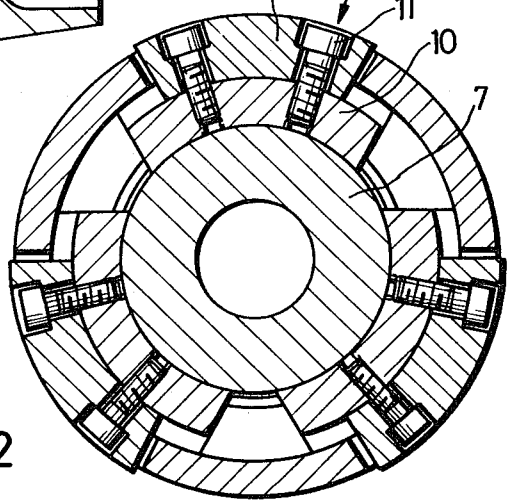
FIG. 2 is a cross-sectional view along line A-B in FIG. 1.

Reference number 1 indicates a casing of a projectile, for example a 150 mm-caliber projectile, the rear portion of which including the guide band has been turned in a lathe. The insert member 2 is screwed into the threaded portion 15 of the casing 1. The insert member 2 has an exterior contour which conforms to that of the rear end of an artillery projectile and complements the casing 1 in such a way that jointly the two have the original length of a life projectile. Three guide band segments 4 serve as a guide band, each of which consists of an outer segment 9 and an inner segment 10. The two segments 9 and 10 are joined to each other by connecting means 11, for example screws or threaded bolts, which are accessible from the outside, whereby the two segments are securely and yet exchangeably connected to each other. Thereby there is attained that the upper segment portion can be formed as a wear part, which is easily exchangeable, without the projectile having to be disassembled.

By axially, slidably displacing the biasing cone 7 the guide band segments are pressed against a stop 8 of the inner wall of the insert member 2 and thereby are pressed until they correspond to the guide band diameter.

In the embodiment of the invention three segments 4 are provided. Thereby a centering of the projectile in the gun barrel is assured. The pull rod 6 can be screwed into the biasing cone 7 by way of a threaded head portion 12 on the pull rod 6 which is adapted to threadably mesh with an internal threaded portion 12' in the biasing cone 7. The biasing cone 7 in turn is rotatably mounted by means of the external threaded portion 13 in a corresponding threaded bore of the insert member 2. In view of the fact that the threaded portions 12 and 13 have respectively opposite pitch it is possible, that after threadably inserting the pull rod 6, the further rotation of the rod 6 causes the biasing cone 7 to be threadably pulled rearwardly and thereby the guide band segments are released.

According to an alternate embodiment of the invention in those cases, in which the test or practice projectile is too strongly clamped or jammed within the gun barrel and a correspondingly increased pulling-out force is required, there is provided at the pull-out a knee-lever construction, which is adapted to bear against a bottom piece and, at activation of the projectile, is ripped off. The guide band segments can also be actuated by a knee-lever via a spindle, so that the guide band segments cannot only be forcibly pressed outwardly, but also can be forcibly pulled inwardly and thereby released.

The function of the projectile during a testing process is for example as follows:

The biasing cone 7 is screwed in so far that the three guide band segments 4 are pressed outwardly against the stop 8. The projectile is set up and the guide band segments 4 press into the rifling grooves of the gun barrel. For pulling out the projectile the release and pull rod 6 is screwed into the biasing cone 7. By a simple further rotation of the pull rod the biasing cone 7 is moved rearwards and thereby the guide band segments 4 are released, whereafter the projectile can be pulled out of the gun barrel by means of the pull rod 6. Thereby a testing and practice projectile is provided which can be reused and which is also easily pulled out of the gun barrel. When the outer segments 7 are worn, a simple exchange of the segments is the only thing that is required. A complete ammunition flow is therefore reproducible and testible at any selected gun barrel elevation. The operational testing is simplified and time and cost savings are achieved at testing and practice firing. Complex tests can eventually be achieved with a lower material expenditure.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. Testing and/or practice projectile assembly for preselected use in an artillery weapon in lieu of a preselected conventional live projectile, comprising in combination, a casing having a rear portion and having an axial length which is less than that of the conventional projectile by a predetermined distance;

an insert member having an internal bore is operatively mounted on said casing, the length and diameter of said insert member is such that the exterior contour and total length of the projectile assembly when the insert member has been operatively mounted on said casing corresponds to that of the conventional projectile; said insert member has at least one annular recess;

a guide band segment is operatively mounted in each recess of said insert member;

a biasing cone axially mounted in the bore of said insert member;

and a pull rod adapted to be operatively coaxially connected to said biasing cone so as to selectively bias said guide band member outwardly to conform to a predetermined exterior guide band diameter and to retractably release it so as to selectively release the band segments.

2. The testing and/or practice projectile assembly as set forth in claim 1, wherein said guide band segments being selectively contacted by said biasing cone when moving in a first direction and pushed outwardly against a surface of said insert members which forms a stop to thereby assume the dimension of a preselected guide band diameter; whereby when said biasing cone moves in a second direction opposite to said first direction said guide band segments are retractably released.

3. The testing and/or practice projectile assembly as set forth in claim 2, wherein said guide band segments consist of two concentrically arranged band portions, the exterior band portion of said band portions is detachably connected to the interior band portion by means which are accessible from outside of the projectile.

4. The testing and/or practice projectile assembly as set forth in claim 3, wherein the pull rod has a front end threaded portion of a first preselected thread pitch in a first direction, said biasing cone having an internal axial threaded bore adapted to matingly mesh with said front end threaded portion, said biasing cone having an exterior threaded portion of a second preselected thread pitch which is in a second direction opposite to said first direction; said insert member having internal threaded bore adapted to matingly mesh with said exterior threaded portion of said biasing cone; whereby when said front end threaded portion is screwed into said axial threaded bore of said biasing cone a predetermined distance a further rotation of said pull rod will cause said biasing cone to be screwed into said internal threaded bore of the insert member thereby moving said biasing cone rearwardly and retractably releasing said guide band segments.

5. The testing and/or practice projectile assembly as set forth in claim 4, including a stop ring coaxially mounted in the rear end of said internal bore of said insert member, said stop ring preventing said biasing cone from being pulled out of said insert member.

* * * * *